United States Patent [19]

Zaccaria

[11] 4,094,257

[45] June 13, 1978

[54] FOLD UP ARTIST PALETTE, PAINT AND ACCESSORY STAND

[76] Inventor: Nathan J. Zaccaria, 257 Glenn Ave., Palisades Park, N.J. 07650

[21] Appl. No.: 792,664

[22] Filed: May 2, 1977

[51] Int. Cl.[2] ..... A47B 3/00

[52] U.S. Cl. ..... 108/115; 108/25; 312/231

[58] Field of Search ..... 108/25, 111, 115, 1, 108/6; 248/465; D6/28; 312/255, 231; 211/181

[56] References Cited

U.S. PATENT DOCUMENTS

| | | | |
|---|---|---|---|
| 154,583 | 9/1974 | Chormann | 312/231 |
| D. 170,497 | 9/1953 | Ehrman | D6/28 |
| 404,146 | 5/1889 | Ackerman | 248/465 |
| 559,743 | 5/1896 | Ormsby | 108/25 |
| 654,841 | 7/1900 | Sabin-McDonald | 312/231 |
| 968,920 | 8/1910 | Campbell | 312/255 |
| 2,725,205 | 11/1955 | Wagler | 211/181 X |
| 3,304,045 | 2/1967 | Bethoney | 248/465 X |
| 3,368,786 | 2/1968 | Bulman | 248/465 X |

*Primary Examiner*—James T. McCall
*Attorney, Agent, or Firm*—Richard L. Miller

[57] ABSTRACT

A stand designed especially for use by an artist in order to support his various supplies; the stand including a triangular base for resting flat on a floor a single leg and a leg brace pivotally attached to opposite side edges of the base, the leg pivotally supporting a box integral with a table top panel along one side thereof; and the stand being foldable for convenient storage or transportation.

6 Claims, 7 Drawing Figures

FOLD UP ARTIST PALETTE, PAINT AND ACCESSORY STAND

This invention relates generally to artist's supplies. More specifically, it relates to a stand for artist's equipment.

A principal object of the present invention is to provide a stand for holding artist's equipment such as a palette, paints, brushes and the like, and which is of foldable type that can be quickly and easily set up or folded away so that it is paricularly adaptable to be portable.

Another object is to provide a fold up artist palette, paint and accessory stand which is made of a minimum number of light weight parts so that it is not tiring to be carried, and which when erected, is very strong and cannot be accidentally knocked over or blown down by a wind if set up out-of-doors.

Yet another object is to provide a fold up artist palette, paint and accessory stand which is attractive in appearance when permanently set up in a studio or home, so to not detract from a room decor.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

Figure 1:
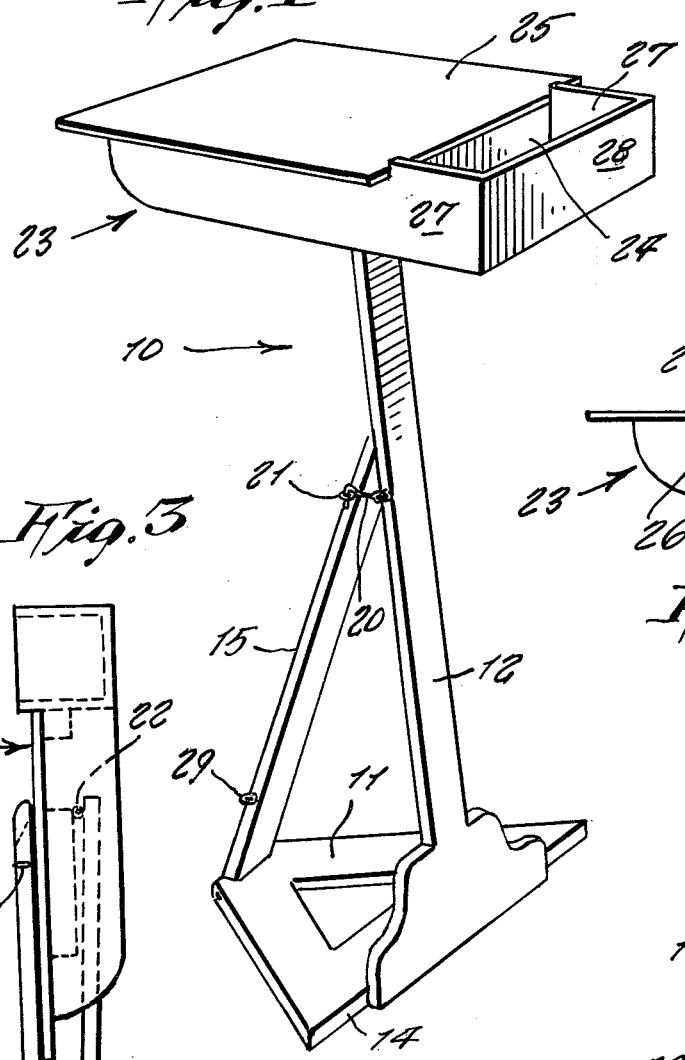
FIG. 1 is a perspective view of the invention shown erected for use.
Figure 5:
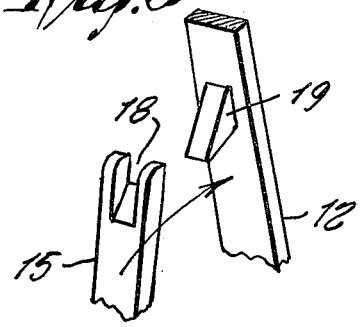
FIG. 5 is a detail of the fork connection.
Figure 5:
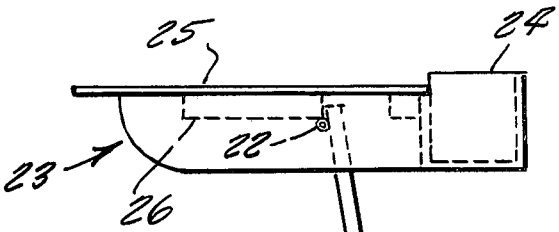
Figure 3:
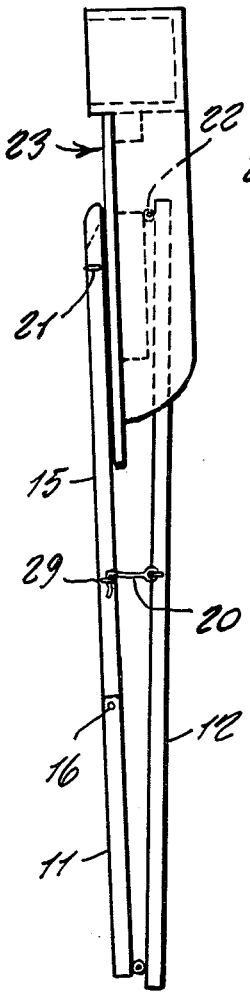
FIG. 3 is a side view thereof in collapsed position.
Figure 2:
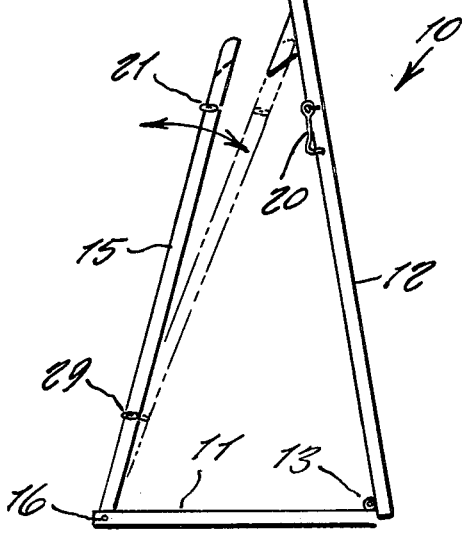
FIG. 2 is a side view thereof.
Figure 4:
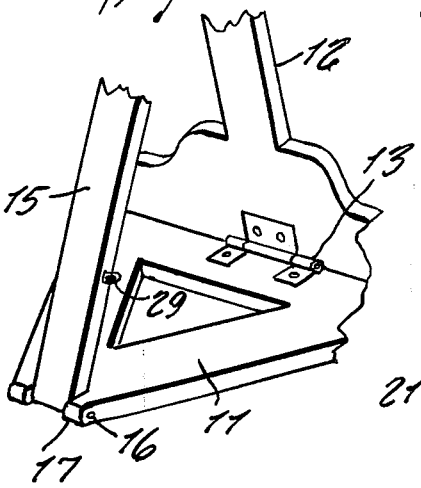
FIG. 4 is a detail of the base hinge connections.

Referring now to the drawing FIGS. 1 to 5, in greater detail, the reference numeral 10 represents a fold up artist palette, paint and accessory stand according to the present invention wherein the same may be made all of wood except for hardware; the stand including a triangular shaped flat base 11 for resting flat on a floor or ground. A lower end of a leg 12 is pivotally secured by a hinge 13 to a straight side edge 14 of the triangular base, while a lower end of a brace 15 is pivotally attached by a hinge pin 16 to an opposite apex 17 of the triangular base. The upper end of the brace is attachable to a longitudinally intermediate portion of the leg by means of a forked notch 18 on the brace fitting a spur 19 protruding from one side of the leg, and a latch hook 20 attached to the leg engaging an eye screw 21 on the brace so that the spur cannot accidentally disengage from the notch but is thus locked therein. The underside of the spur extends angularly downward from the leg and the notch face corresponds thereto.

The upper end of the leg is pivotally attached by means of a hinge 22 to a stand top 23 on which the palette rests while the artist is painting, and includes a long box 24 in which brushes, paints and paint medium may be placed. The hinge 22 is secured to a block 26, secured on an underside of the panel. The box is open at the top and the side panel edge which protrudes above the top, forms two edges which prevent the palette from sliding forward while the artist dips the brush into the paint clusters placed on the palette.

When the stand is in a folded up position, the latch hook 20 aligns with an eye screw 29 on the brace so to firmly lock the stand in the collapsed position.

Figure 6:
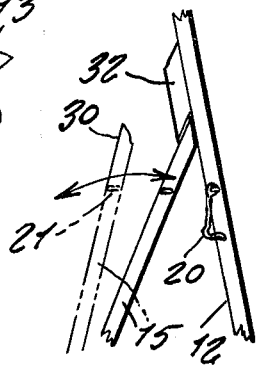
FIG. 6 is a side view of a modified design of fork connection.
Figure 7:
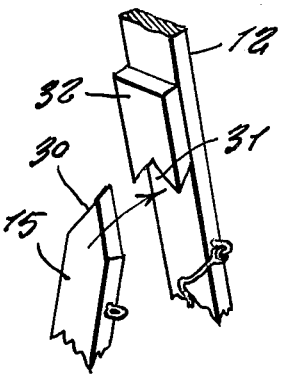
FIG. 7 is a perspective view thereof.

In a modified design of the invention, shown in FIGS. 6 and 7, the above described notch and spur are substituted by a tapered point 30 on the upper end of the brace being receivable in a V-shaped notch 31 formed on the underside of a block 32 affixed to the leg. The point and notch are tapered in two planes so to insure against accidental disengagement even if the latch hook is not locked.

In use, the stand can serve indoors in a studio or out-of-doors in a field.

While certain novel features of this invention have been shown and described and are pointed out in the annex claims, it will be understood that various omissions, substitutions and changes in the forms and details of the device illustrated and in its operation can be made by those skilled in the art without departing from the spirit of the invention.

What is claimed is:

1. A fold up artist palette, paint and accessory stand comprising, in combination: a base having a flat lower surface and front and rear sides; a single leg pivotally connected to said front side of said base; a brace pivotally connected to said rear side of said base; coupling means for detachably coupling an upper end of said brace to an intermediate portion of said leg, said coupling means comprising a bifurcated member having a support surface between the bifurcation; and a stud member fitting into said bifurcated member and having a cooperating surface engaging said support surface, said bifurcated member being positioned on one of said brace or leg, and said stud member being positioned on the other, whereby secure engagement is maintained in an assembled condition while permitting easy separation thereof for disassembly; and a stand top pivotally connected to the upper end of said leg and in assembled condition lying parallel to said lower base surface.

2. The combination as set forth in claim 1 wherein said bifurcated member includes a forked notch positioned on the upper end of said base, and said stud member includes a spur positioned on a side of said leg.

3. The combination as set forth in claim 1 wherein said bifurcated member includes a block secured to a side of said leg, a V-shaped notch formed on an underside of said block, and said stud member includes a tapered point formed at the end of said brace.

4. The combination as set forth in claim 1 wherein said support surface is downwardly inclined from said leg and makes an acute angle therewith in an assembled condition.

5. The combination as set forth in claim 1 and further comprising hook means interconnected between said brace and said leg to aid in maintaining said coupling means engaged during its assembled condition.

6. The combination as set forth in claim 1 wherein said stand top comprises a box that is open on top and a table top panel.

* * * * *